US007112070B2

(12) United States Patent
Huang

(10) Patent No.: US 7,112,070 B2
(45) Date of Patent: Sep. 26, 2006

(54) CONNECTOR

(75) Inventor: Chung-Jung Huang, Pingzhen (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 11/079,069

(22) Filed: Mar. 14, 2005

(65) Prior Publication Data

US 2005/0208795 A1 Sep. 22, 2005

(30) Foreign Application Priority Data

Mar. 17, 2004 (TW) ..... 93204018 U

(51) Int. Cl.
*H01R 12/00* (2006.01)

(52) U.S. Cl. ..... 439/79; 439/247; 439/541.5

(58) Field of Classification Search ..... 439/79, 439/247, 541.5

See application file for complete search history.

(56) References Cited

U.S. PATENT DOCUMENTS

| | | | | |
|---|---|---|---|---|
| 6,447,307 | B1 * | 9/2002 | Wu | 439/79 |
| 6,561,829 | B1 * | 5/2003 | Maeda et al. | 439/247 |
| 6,604,952 | B1 * | 8/2003 | Miwa et al. | 439/79 |
| 6,702,593 | B1 * | 3/2004 | Ogawa | 439/79 |
| 6,817,906 | B1 * | 11/2004 | Zhou | 439/752.5 |

* cited by examiner

*Primary Examiner*—Truc Nguyen
(74) *Attorney, Agent, or Firm*—Thomas, Kayden, Horstemeyer & Risley

(57) ABSTRACT

A connector connected to a printed circuit board. The connector comprises a first conducting member, a second conducting, and an insulating base. The first conducting member has a first horizontal section, and the second conducting member has a second horizontal section. The insulating base comprises a body and a supporting portion. The body fixes the first and second horizontal sections, and the supporting portion abuts the printed circuit board so that the first and second horizontal sections maintain a predetermined orientation with the printed circuit board.

14 Claims, 3 Drawing Sheets

CONNECTOR

BACKGROUND

The invention relates to a connector and in particular to a connector that can maintain stable contact during passage through a tin furnace.

A printed circuit board in an electronic device may comprise electronic components disposed thereon. During manufacture, an electronic component may be inserted into the printed circuit board without fastening, after which conducting pins are welded to the rear of the printed circuit board by passage through a tin furnace.

This method provides efficient mass production of printed circuit boards, however, since the electronic component is not fastened during passage through the tin furnace, vibration from transfer belts and changes in elevation can result in slant or wrong alignment of the components, such that the components are not parallel to the printed circuit board which makes the components unable to connect with other components.

SUMMARY

The invention discloses a connector that solves the above mentioned problem. The connector is stably disposed to avoid misalignment during passage through a tin furnace, enabling secure subsequent insertion and separation of the connector with other connectors.

The connector of embodiments of the invention comprises a first conducting member, a second conducting member, and an insulating base. The insulating base comprises a body and a supporting portion. The body fixes the first and second conducting members, and the supporting portion abuts the printed circuit board so that the first and second conducting members maintain a predetermined orientation with the printed circuit board.

The predetermined orientation may be parallel to the printed circuit board. Further, the first conducting member comprises a first horizontal section and second conducting member comprises a second horizontal section. The first and second horizontal sections are parallel to the printed circuit board.

The first conducting member further comprises a first vertical section connecting to the first horizontal section and fixed by the supporting portion, and the supporting portion abuts the printed circuit board so that the first vertical section and the printed circuit board form a predetermined angle therebetween. The predetermined angle may be 90°.

In an embodiment, the supporting portion may comprise a cantilever extending from the body. The cantilever abuts the printed circuit board so that the first vertical section and the printed circuit board form a predetermined angle therebetween. The predetermined angle may be 90°.

In another embodiment, the supporting portion may comprise two cantilevers extending from the body and disposed at two sides of the first vertical section. The cantilevers abut the printed circuit board so that the first vertical section and the printed circuit board form a predetermined angle therebetween. The predetermined angle may comprise 90°.

The second conducting member further comprises a second vertical section connecting to the second horizontal section. The supporting portion abuts the printed circuit board so that the first and second vertical sections and the printed circuit board form a predetermined angle therebetween. The predetermined angle may be 90°.

The body and the supporting portion may be separable or integrally formed with the supporting portion extending from the body.

In an embodiment, the first conducting member further comprises a first vertical section and the second conducting member further comprises a second vertical section. The supporting portion fixes the first vertical section, and the body fixes the first and second horizontal sections. The first vertical section is substantially perpendicular to the printed circuit board, the first and second horizontal sections are substantially parallel to the printed circuit board, and the second vertical section then is substantially perpendicular to the printed circuit board.

DESCRIPTION OF THE DRAWINGS

Embodiments of the invention can be more fully understood by reading the subsequent detailed description in conjunction with the examples and references made to the accompanying drawings, wherein.

DETAILED DESCRIPTION

First Embodiment

Figure 1A:
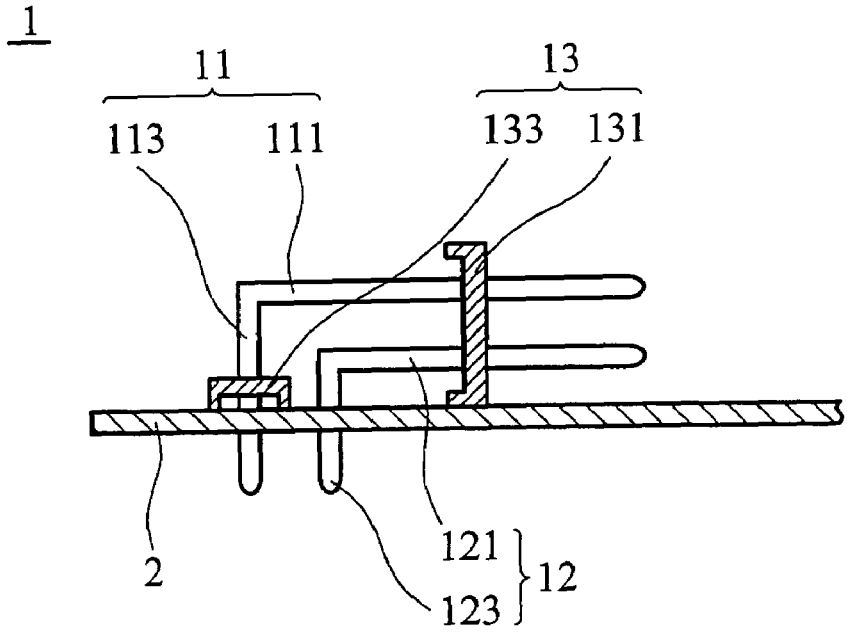
FIG. 1A is a side view of a connector of a first embodiment of the invention.
Figure 1B:
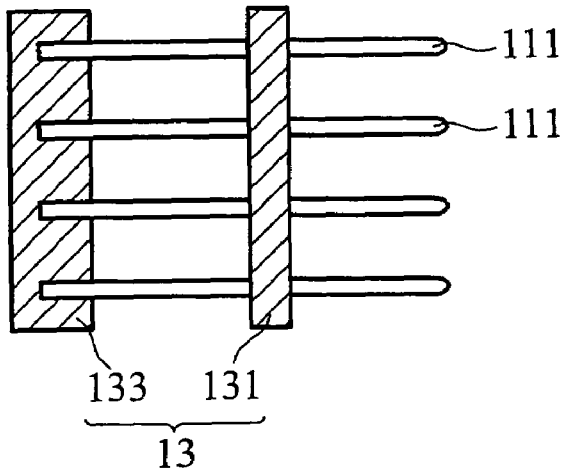
FIG. 1B is a top view of the connector of the first embodiment.

FIGS. 1A and 1B show a connector of a first embodiment of the invention. FIG. 1A is a side view of the connector disposed on a printed circuit board. FIG. 1B is a top view of the connector.

The connector 1 comprises a first conducting member 11, a second conducting member 12, and an insulating base 13. The first conducting member 11 comprises a first horizontal section 111 and a first vertical section 113. The second conducting member 12 comprises a second horizontal section 121 and a second vertical section 123. The insulating base 13 comprises a body 131 and a supporting portion 133. The first horizontal section 111 and the second horizontal section 121 pass through and are fixed by the body 131. The first vertical section 113 passes through and is fixed by the supporting portion 133. For clarity, since the first conducting member 11 and the second conducting member 12 are parallel, FIG. 1B shows only the first conducting member 11 and not the second conducting member 12 obstructed thereby.

During manufacture, the connector 1 is disposed on a printed circuit board 2, and the printed circuit board 2 enters a tin furnace. Solder wave (not shown) in the tin furnace is sprayed on the rear of the printed circuit board 2, and such that the connector 1 is soldered on the printed circuit board 2. In the tin furnace, the supporting portion 133 of the insulating base 13 balances the connector 1. The supporting portion 133 abuts the printed circuit board 2 so that the first and second horizontal sections 111 and 121 of the first and second conducting members 11 and 12 maintain a predetermined orientation with the printed circuit board 2, for example, substantially parallel thereto. Further, the first and second vertical sections 113 and 123 of the first and second conducting members 11 and 12 and the printed circuit board 2 form a predetermined angle therebetween, for example, 90°. Thus, the connector 1 maintains its position on the printed circuit board 2 without warping during the heating process. In this embodiment, the body 131 and the supporting portion 133 of the insulating base 13 are separable. In FIG. 1B, the supporting portion 133 is striped, with the extending direction thereof perpendicular to the first and second vertical sections 113 and 123. The body 131 and the supporting portion 133 are substantially parallel.

Second Embodiment

Figure 2A:
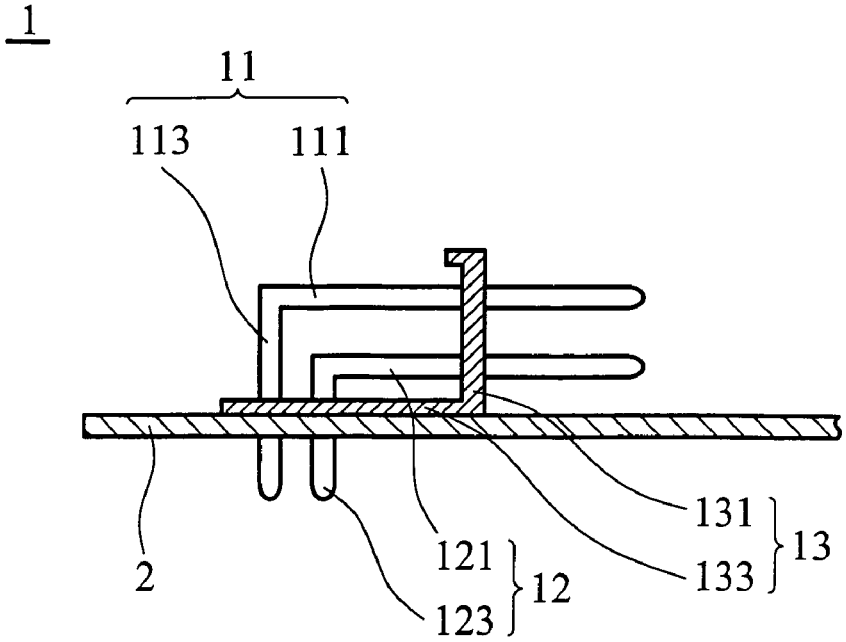
FIG. 2A is a side view of a connector of second, third, and fourth embodiments of the invention.
Figure 2B:
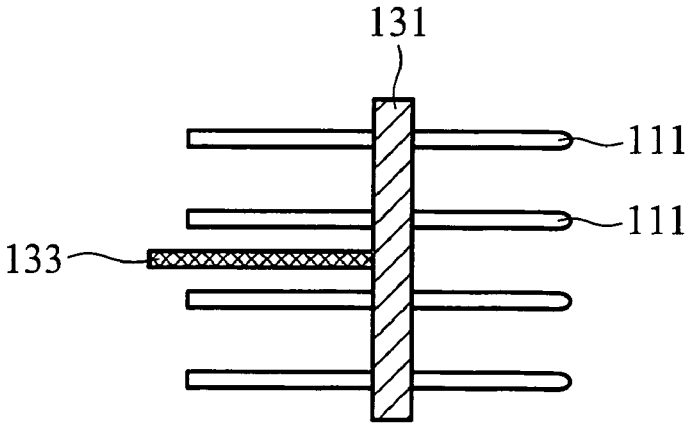
FIG. 2B is a top view of the connector of the second embodiment.

FIGS. 2A and 2B show a connector of a second embodiment of the invention. FIG. 2A is a side view of the connector disposed on a printed circuit board, and FIG. 2B is a top view of the connector, with like numbers indicating like and corresponding parts.

The connector 1 comprises a first conducting member 11, a second conducting member 12, and an insulating base 13. The first conducting member 11 comprises a first horizontal section 111 and a first vertical section 113. The second conducting member 12 comprises a second horizontal section 121 and a second vertical section 123. The insulating base 13 comprises a body 131 and a supporting portion 133. The body 131 supports and fixes the first and second horizontal sections 111 and 121. In FIG. 2B, the supporting portion 133 is a cantilever extending from the body 131, parallel to the first and second horizontal sections 111 and 121.

The connector 1 is disposed on a printed circuit board 2, and the printed circuit board 2 enters a tin furnace. Solder wave (not shown) in the tin furnace is sprayed on the rear of the printed circuit board 2, and such that the connector 1 is soldered on the printed circuit board 2. In the tin furnace, the supporting portion 133 of the insulating base 13 balances the connector 1. The supporting portion 133 abuts the printed circuit board 2 so that the first and second horizontal sections 111 and 121 of the first and second conducting members 11 and 12 maintain a predetermined orientation with the printed circuit board 2, for example, substantially parallel thereto. Further, the first and second vertical sections 113 and 123 and the printed circuit board 2 form a predetermined angle therebetween, for example, 90°. Thus, the connector 1 maintains its position on the printed circuit board 2 without warping during the heating process and passage through the tin furnace. In this embodiment, the body 131 and the supporting portion 133 of the insulating base 13 are integrally formed, with supporting portion 133 extending from the body 131. The supporting portion 133 is disposed at the center of the body 131, between adjacent first vertical sections 113. Conducting members 11 and 12 are parallel so that the supporting portion 133 is also between adjacent second vertical sections 123.

Third Embodiment

Figure 2C:
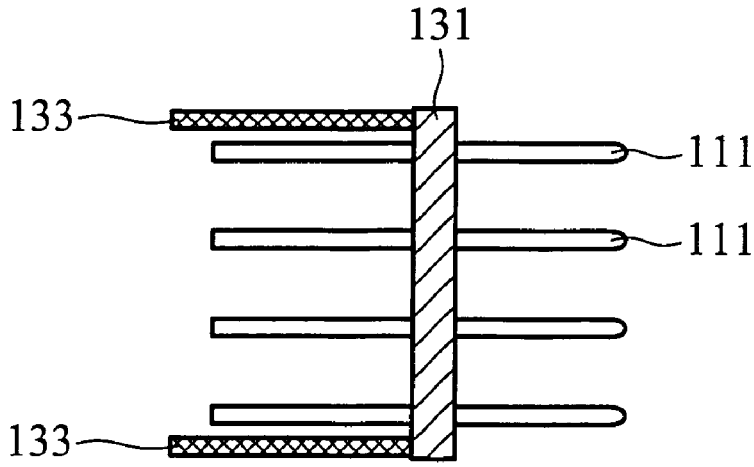
FIG. 2C is a top view of the connector of the third embodiment.

FIGS. 2A and 2C show a connector of a third embodiment of the invention. FIG. 2A is a side view of the connector disposed on a printed circuit board, and FIG. 2C is a top view of the connector, with like numbers indicating like and corresponding parts, and with elements and descriptions common to the first and second embodiments omitted.

In FIG. 2C, supporting portion 133 comprises two cantilevers extending from the body 131, substantially parallel to the first and second horizontal sections 111 and 121.

In the third embodiment, unlike first and second embodiments, the supporting portion 133 is disposed on two sides of the body 131, and also disposed on two sides of the first and second conducting members 11 and 12. The supporting portion 133 is disposed on two sides of first and second vertical sections 113 and 123, enhancing the strength of supporting portion 133 of base 13 abutting the printed circuit board 2.

Fourth Embodiment

Figure 2D:
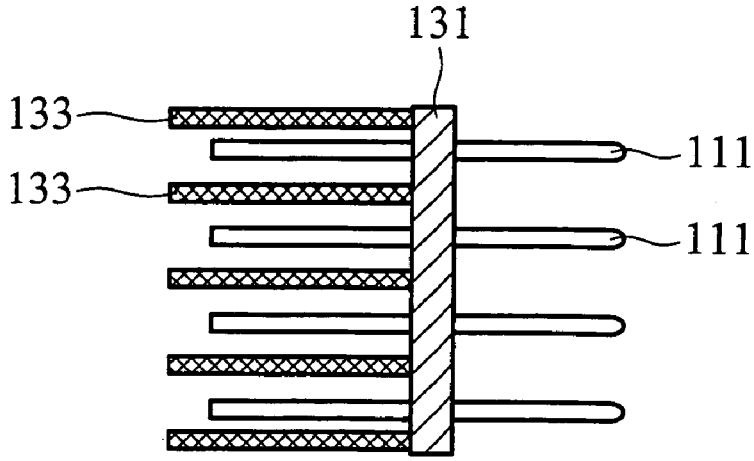
FIG. 2D is a top view of the connector of the fourth embodiment.

FIGS. 2A and 2D show a connector of a fourth embodiment of the invention. FIG. 2A is a side view of the connector disposed on a printed circuit board, and FIG. 2D is a top view of the connector, wherein like numbers indicate like and corresponding parts, and elements and descriptions common to previously disclosed embodiments omitted.

In FIG. 2D, supporting portion 133 comprises a plurality of cantilevers extending from the body 131, substantially parallel to the first and second horizontal sections 111 and 121.

In this embodiment, unlike previously disclosed embodiments, the supporting portion 133 is disposed between every two adjacent first vertical sections 113. The supporting portion 133 is also disposed between every two adjacent second vertical sections 123, enhancing the strength of supporting portion 133 of base 13 abutting the printed circuit board 2.

Finally, while the invention has been described by way of example and in terms of the preferred embodiments, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A connector connecting to a printed circuit board, comprising:

a first conducting member having a first horizontal section and a first vertical section;

a second conducting member having a second horizontal section and a second vertical section; and an insulating base providing a body and a supporting portion, wherein the body fixes the first and second horizontal sections, and the supporting portion abuts the printed circuit board and the first vertical section without contacting the second vertical section such that the first and second horizontal sections maintain a predetermined orientation with the printed circuit board.

2. The connector as claimed in claim 1, wherein the predetermined orientation is parallel to the printed circuit board.

3. The connector as claimed in claim 1, wherein the first conducting member is fixed by the supporting portion, and the supporting portion abuts the printed circuit board so that the first and second vertical sections and the printed circuit board form a predetermined angle therebetween.

4. The connector as claimed in claim 1, wherein the supporting portion comprises a cantilever extending from the body, the cantilever abutting the printed circuit board so that the first vertical section and the printed circuit board form a predetermined angle therebetween.

5. The connector as claimed in claim 1, wherein the supporting portion comprises two cantilevers extending from the body, disposed on two sides of he first vertical section, the cantilevers abutting the printed circuit board so that the first vertical section and the printed circuit board form a predetermined angle therebetween.

6. The connector as claimed in claim 1, wherein the body and the supporting portion are integrally formed, and the supporting portion extends from the body.

7. The connector as claimed in claim 1, further comprising a plurality of first conducting members, wherein the supporting portion is interdigitally placed between the first conducting members.

8. The connector as claimed in claim 3, wherein the predetermined angle is substantially 90°.

9. The connector as claimed in claim 4, wherein the predetermined angle is substantially 90°.

10. The connector as claimed in claim 5, wherein the predetermined angle is substantially 90°.

11. A connector connecting to a printed circuit board, comprising:

a first conducting member having a first horizontal section and a first vertical section;

a second conducting member having a second horizontal section and a second vertical section; and an insulating base providing a body and a supporting portion, wherein the body fixes the first and second horizontal sections, and the supporting portion abuts the printed circuit board and fixes one, but not the other, of the first and second vertical sections such that the first and second horizontal sections maintain a predetermined orientation with the printed circuit board, and the first vertical section is substantially perpendicular to the printed circuit board, the first and second horizontal sections are substantially parallel to the printed circuit board, and the second vertical section then is substantially perpendicular to the printed circuit board.

12. The connector as claimed in claim 11, wherein the predetermined angle is substantially 90°.

13. The connector as claimed in claim 11, wherein the body and the supporting portion are separable.

14. A connector connecting to a printed circuit board, comprising:

a first conducting member having a first horizontal section and a first vertical section;

a second conducting member having a second horizontal section and a second vertical section; and an insulating base comprising a body portion and a supporting portion, wherein the body portion abuts the printed circuit board and contacts both the first and second horizontal sections, and the supporting portion abuts the printed circuit board and the first vertical section without contacting the-second vertical section.

* * * * *